US009982872B1

(12) United States Patent
Kearney et al.

(10) Patent No.: US 9,982,872 B1
(45) Date of Patent: May 29, 2018

(54) TRANSLUCENT END CAP FOR LUMINAIRE

(71) Applicants: Thomas Joseph Kearney, Berkley, MI (US); Frederick William Sorensen, Traverse City, MI (US)

(72) Inventors: Thomas Joseph Kearney, Berkley, MI (US); Frederick William Sorensen, Traverse City, MI (US)

( * ) Notice: Subject to any disclaimer, the term of this patent is extended or adjusted under 35 U.S.C. 154(b) by 0 days. days.

(21) Appl. No.: 15/370,963

(22) Filed: Dec. 6, 2016

Related U.S. Application Data

(60) Provisional application No. 62/386,565, filed on Dec. 7, 2015.

(51) Int. Cl.

| | |
|---|---|
| ***F21V 15/015*** | (2006.01) |
| ***F21V 3/04*** | (2018.01) |
| ***F21S 4/28*** | (2016.01) |
| ***F21V 23/00*** | (2015.01) |
| ***F21V 29/508*** | (2015.01) |
| ***F21V 29/60*** | (2015.01) |
| *F21Y 115/10* | (2016.01) |
| *F21Y 103/10* | (2016.01) |

(52) U.S. Cl.
CPC ..... *F21V 15/015* (2013.01); *F21S 4/28* (2016.01); *F21V 3/0436* (2013.01); *F21V 23/005* (2013.01); *F21V 29/508* (2015.01); *F21V 29/60* (2015.01); *F21Y 2103/10* (2016.08); *F21Y 2115/10* (2016.08)

(58) Field of Classification Search
CPC ..... F21V 15/015; F21V 29/508; F21V 29/60; F21V 3/0436; F21V 23/005; F21S 4/28; F21Y 2103/10
USPC ..... 362/217.1
See application file for complete search history.

(56) References Cited

U.S. PATENT DOCUMENTS

| | | | | |
|---|---|---|---|---|
| 2,288,606 | A | 7/1942 | Callahan | |
| D445,214 | S | 7/2001 | Lewis | |
| D570,533 | S | 6/2008 | Morgan | |
| D607,145 | S | 12/2009 | Yu | |
| 8,092,040 | B2 | 1/2012 | Wu et al. | |
| D661,833 | S | 6/2012 | Imajo et al. | |
| D663,065 | S | 7/2012 | Beghelli | |
| D665,195 | S | 8/2012 | Hsieh | |
| 8,251,537 | B2 * | 8/2012 | Lee | H01R 33/942 362/219 |
| D713,981 | S | 9/2014 | Law et al. | |
| D714,480 | S | 9/2014 | Law et al. | |

(Continued)

*Primary Examiner* — Laura Tso
(74) *Attorney, Agent, or Firm* — Northern Michigan Patent Law, PLC

(57) ABSTRACT

A translucent end cap for an elongated luminaire having an upper metal housing and a lower translucent lens. The end cap has a vertical translucent face and a horizontal, inwardly extending perimeter wall. The cross-sectional shape of the end cap is different than that of the luminaire, and in particular an upper portion of the end cap and perimeter wall extends above and is non-contiguous with the outer or perimeter edge of the metal upper housing. The perimeter wall of the end cap transmits light from the interior of the luminaire in a vertical plane around the entirety of the luminaire, including above the metal housing for up-lighting. The non-contiguous end cap also provides an aesthetic cover for an upper metal housing with an irregular contour that includes a heat dissipating driver- or ballast-mounting channel with an air channel.

5 Claims, 7 Drawing Sheets

(56) References Cited

U.S. PATENT DOCUMENTS

| | | | | |
|---|---|---|---|---|
| D715,987 | S | 10/2014 | Pugh | |
| 9,103,508 | B2 * | 8/2015 | Shimizu | F21V 3/0445 |
| 2003/0223235 | A1 * | 12/2003 | Mohacsi | F21S 2/00 362/240 |
| 2012/0051041 | A1 * | 3/2012 | Edmond | F21S 8/026 362/231 |
| 2012/0140461 | A1 * | 6/2012 | Pickard | F21V 15/013 362/225 |
| 2014/0321121 | A1 | 10/2014 | Santoro et al. | |
| 2017/0009946 | A1 * | 1/2017 | Jimbo | F21S 8/043 |

* cited by examiner

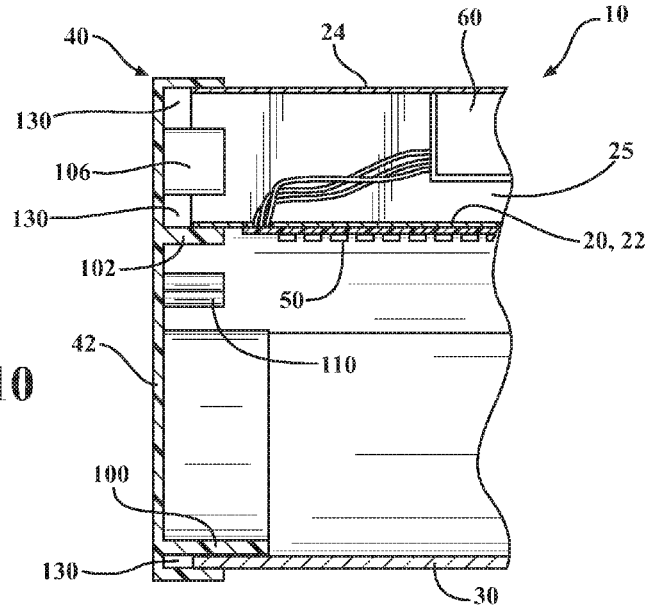
FIG. 10
FIG. 11
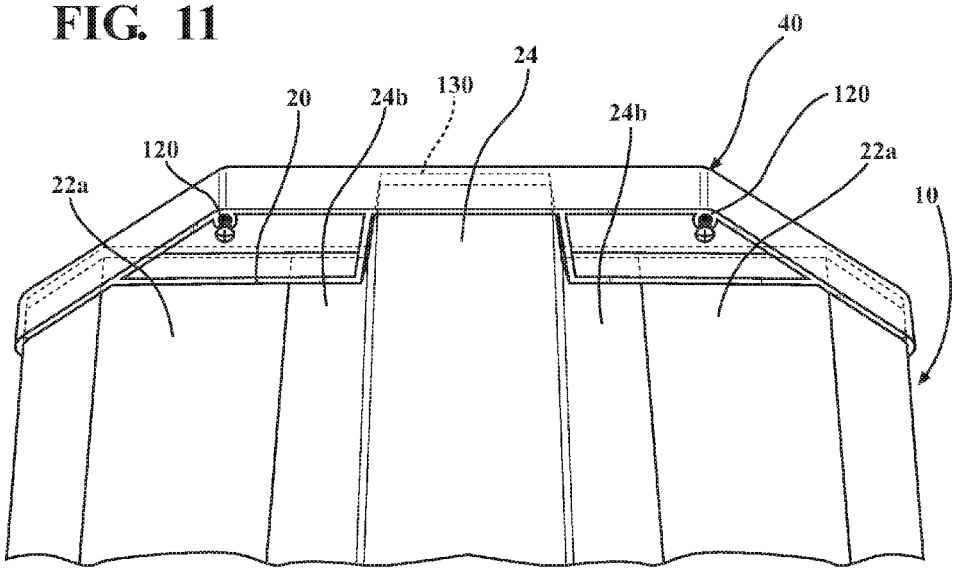

TRANSLUCENT END CAP FOR LUMINAIRE

RELATED APPLICATIONS/PRIORITY BENEFIT CLAIM

This application claims the benefit of U.S. Provisional Application No. 62/386,565 filed Dec. 7, 2015 by the same inventors (Kearney and Sorensen), the entirety of which provisional application is hereby incorporated by reference.

Ornamental aspects of an embodiment shown in the present application are also the subject of a co-pending design patent application titled "LUMINAIRE END CAP" filed Dec. 7, 2016 with application Ser. No. 29/586,856.

FIELD

The subject matter of the present application is in the field of commercial lighting fixtures or "luminaires", in particular to end caps for such fixtures.

BACKGROUND

Traditionally, commercial light housings, called "luminaires", have been made with light gauge aluminum housings to reduce cost and weight. The problem with metal housings is that they block light from the fluorescent or LED bulbs inside.

One known improvement has been to use a translucent end cap either of glass or plastic with a high light transmission factor. One such example is shown in U.S. Pat. No. 2,288,606 to Callahan, with an end cap for a fluorescent lamp fixture that diffuses light from the ends of the fixture. This is achieved by extending a lower portion of the end cap inwardly from the end of the fixture under the elongated fluorescent lamp tube and under an inclined end portion of an internal reflector so that it "encloses" or overlaps the ends of the lamp tube. Some of the light emitted from the ends of the lamp tube is reflected off the bottom portion of the end cap and the inclined reflector against the side or face of the end cap and thus transmitted out the end of the fixture.

Another example is shown in U.S. Pat. No. 8,092,040 to Wu et al, with a fixture having an elliptical tapering cross-section. An elliptical end cap matching the fixture cross-section includes an opaque center and an angled translucent rim toward its outermost edge. This rim can transmit light in a semi-direct manner radially outward or horizontally from the lamps in the interior of the housing. The light transmitted from the translucent rim of the outer end cap appears to be indirectly received from the lamps through openings in an opaque inner end cap or bracket.

Another example is shown in U.S. Patent Application Publication No. US2014/0321121 A1 to Santoro et al, with an end cap optical lens assembly for a lighting fixture. The end cap assembly includes an outer lens, an inner lens, and a reflector. The lenses correspond to the fixture housing cross-section, and are rounded and angled downwardly from the housing at different angles to reflect and diffuse light received from the lamps.

While prior art end caps do provide additional light from the ends of their fixtures, this additional lighting is inefficient relative to the amount of light available for end lighting. Additionally, the prior art caps do not appear to provide any significant up-lighting immediately adjacent the fixture.

BRIEF SUMMARY

The present invention is an improved translucent end cap for an elongated luminaire, the luminaire being of the type that has an elongated opaque metal upper housing and downward facing plastic lens mounting an elongated light emitter such as an LED tube or board. The inventive end cap is a substantially flat, planar, translucent plastic body with a vertical end face mounted at right angles to the long axis of the housing. The cap further comprises a translucent horizontal perimeter wall extending inwardly from and perpendicular to the vertical end face. Light is emitted in a vertical plane from all edges of the end cap, i.e. in a continuous band around the cap perimeter, and thus around the full perimeter of the housing, in addition to the light transmitted through the vertical end face of the cap. In particular, light is emitted from portions of the end cap, including the perimeter wall, spaced vertically above the metal housing.

In a further form, the invention is a combination of the above end cap with a luminaire having an elongated horizontal opaque upper housing and an elongated horizontal lower translucent lens. A lower portion of the perimeter wall of the end cap is substantially contiguous with the perimeter of the lens on the lower part of the fixture, while an upper portion of the perimeter wall is non-contiguous with the perimeter of the fixture's metal upper housing. In particular, the end cap has a perimeter configuration that does not match the cross-section of the luminaire upper housing, such that an upper portion of the end cap's perimeter wall is physically spaced above and emits light in a vertical plane from a position above portions of the upper housing.

In still a further form, the above end cap can be combined with a luminaire metal upper housing having an irregular configuration that in a preferred form defines a heat-dissipating air channel for an LED driver. In one form, the upper housing of the luminaire comprises an essentially flat metal main upper housing wall with a flat LED emitter board secured directly to its inner surface; an elongated metal channel mounted to the outer surface of the upper wall above the LED board; and an LED driver package mounted to an inner surface of the upper wall of the channel and spaced from the upper wall of the main housing by a continuous full-length air channel from one end of the metal housing to the other end.

"Translucent" is used herein to mean either translucent or transparent, sufficient to transmit a useful (rather than merely decorative) amount of light to the surrounding environment. Terms of orientation such as horizontal and vertical applied to different parts of the fixture should be understood as relative to one another, based for convenience on a reference point of a standard horizontal mounting of the luminaire with the elongated light emitter generally parallel to the ground; and, as substantially so rather than absolutely, given reasonable variations and tolerances inherent in manufacturing and mounting the luminaires.

In general the inventive end cap provides a significant improvement in end-lighting, in particular with respect to up-lighting in the area immediately adjacent and above the luminaire. Since luminaire fixtures are often strategically placed near brightly finished ceilings for optimal area lighting, and since their upper housings generally have a reflective finish, the up-lighting effect above the luminaire provides an unusually beneficial diffuse lighting effect for a work area. The inventive end cap also provides more even end lighting, a more aesthetic appearance, and better mounting options when used on luminaires with irregularly shaped metal housings.

These and other features and advantages of the invention will become apparent from the detailed description below, in light of the accompanying drawings.

BRIEF DESCRIPTION OF THE DRAWINGS

FIG. 10 is similar to FIG. 7, but shows the end of the luminaire housing and the end cap in partial section.

FIG. 11 is a perspective upper side end view of an end of the luminaire and an associated end cap from FIG. 3.

DETAILED DESCRIPTION

Figure 1:
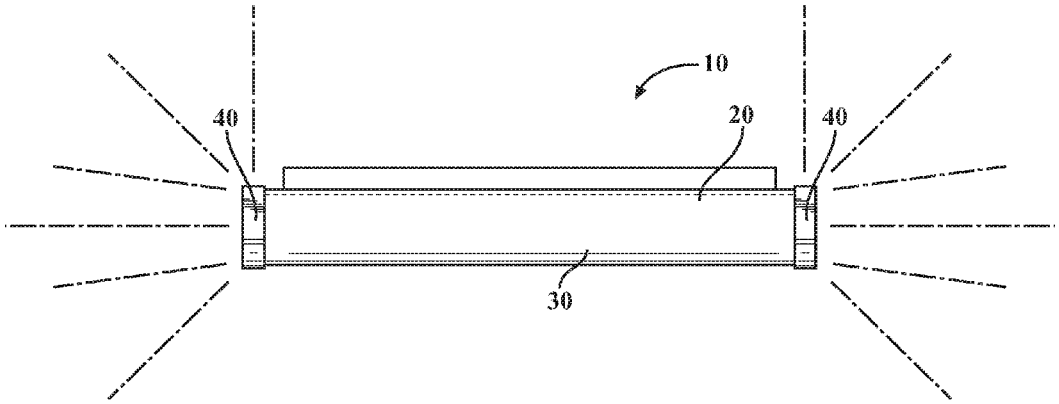
FIG. 1 is a schematic side elevation view of a luminaire provided with an end cap according to the invention.
Figure 2:
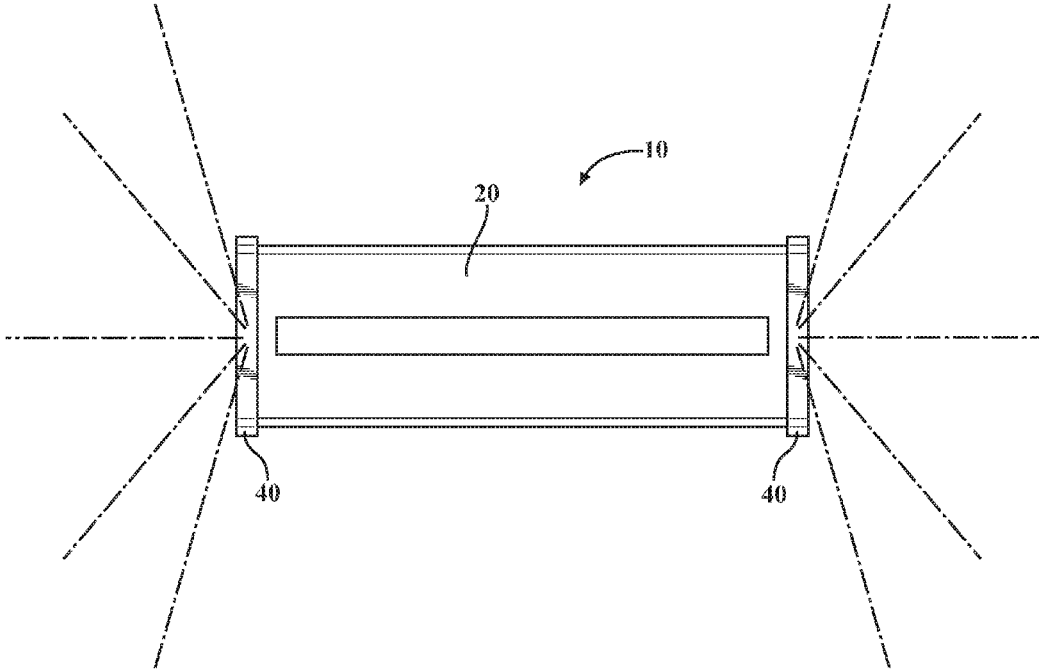
FIG. 2 is a schematic top plan view of the luminaire and end cap of FIG. 1.
Figure 3:
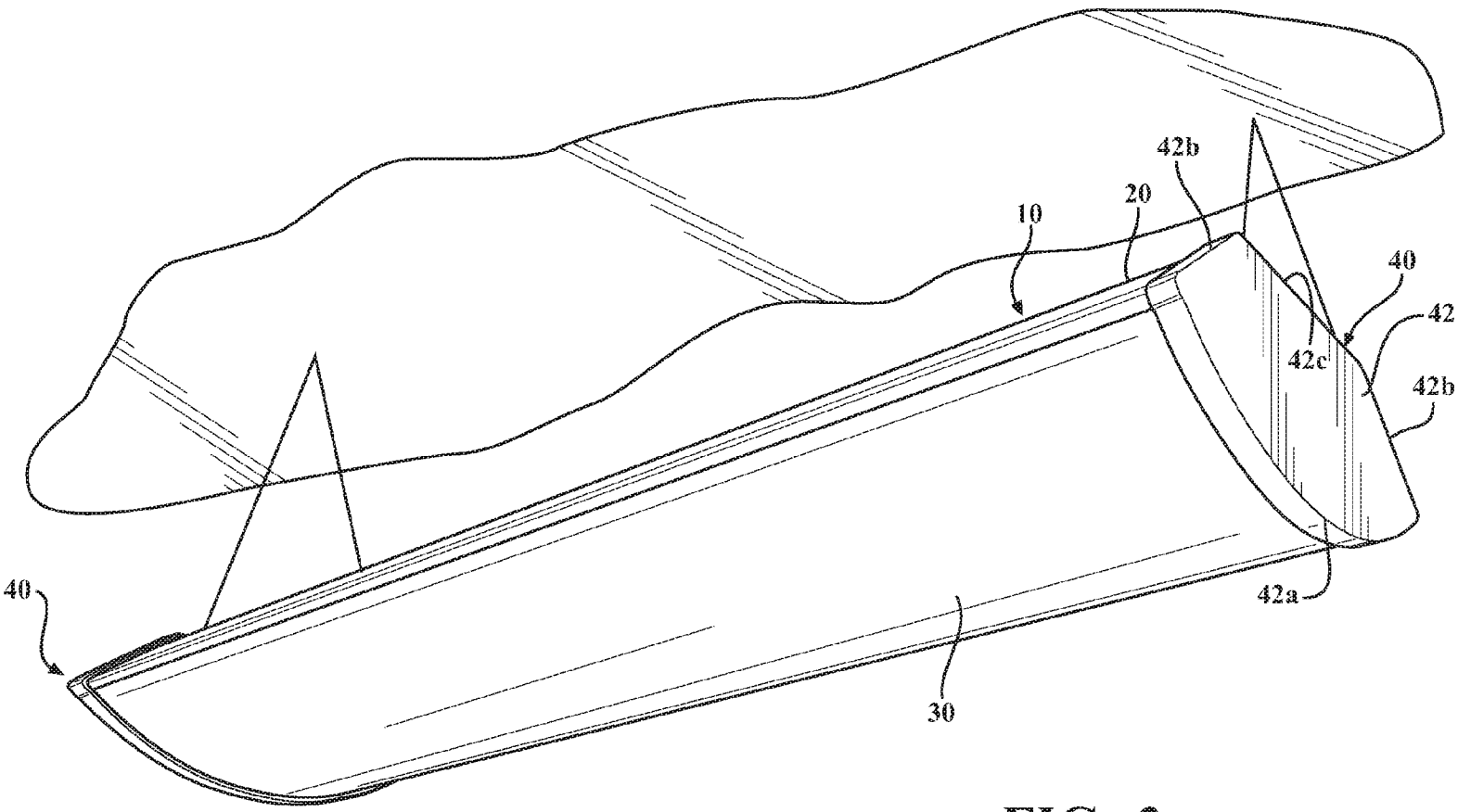
FIG. 3 is a perspective lower side end view of a luminaire provided with exemplary translucent end caps according to the invention.
Figure 4:
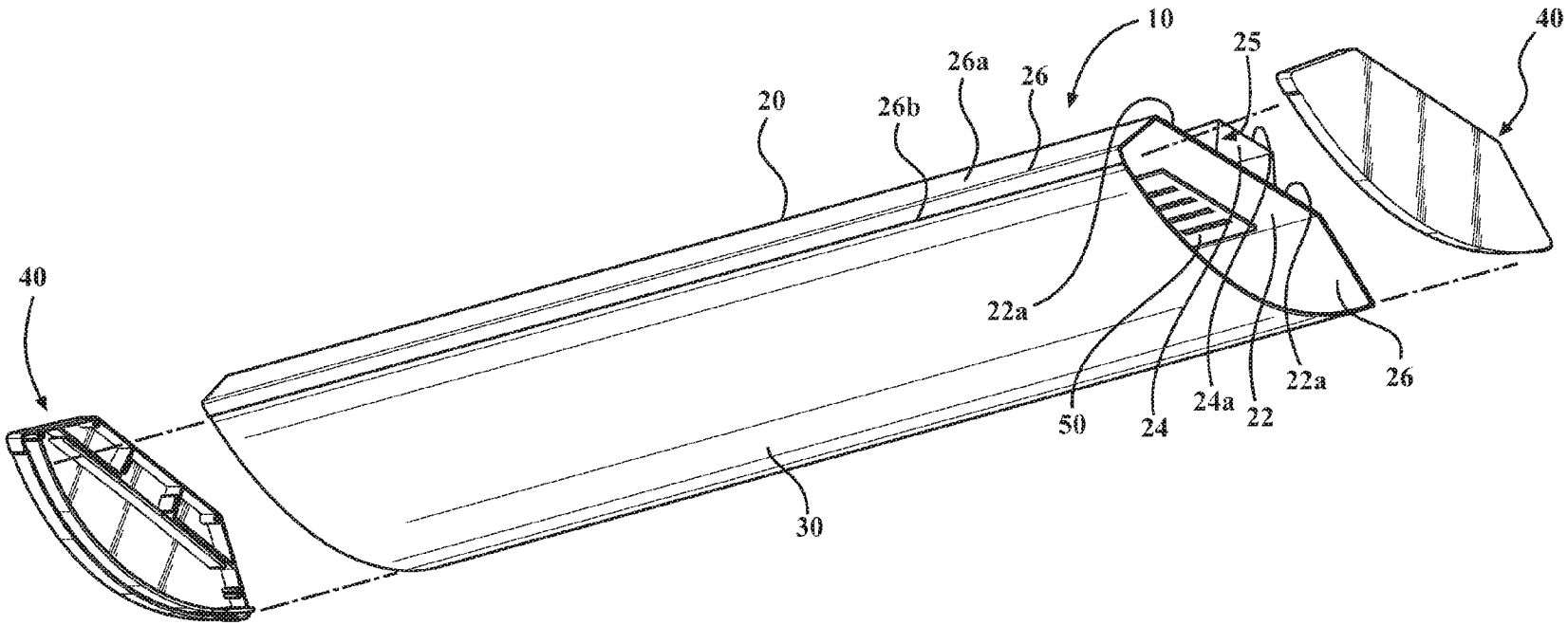
FIG. 4 is similar to FIG. 3, but shows the end caps exploded from the luminaire housing.
Figure 4A:
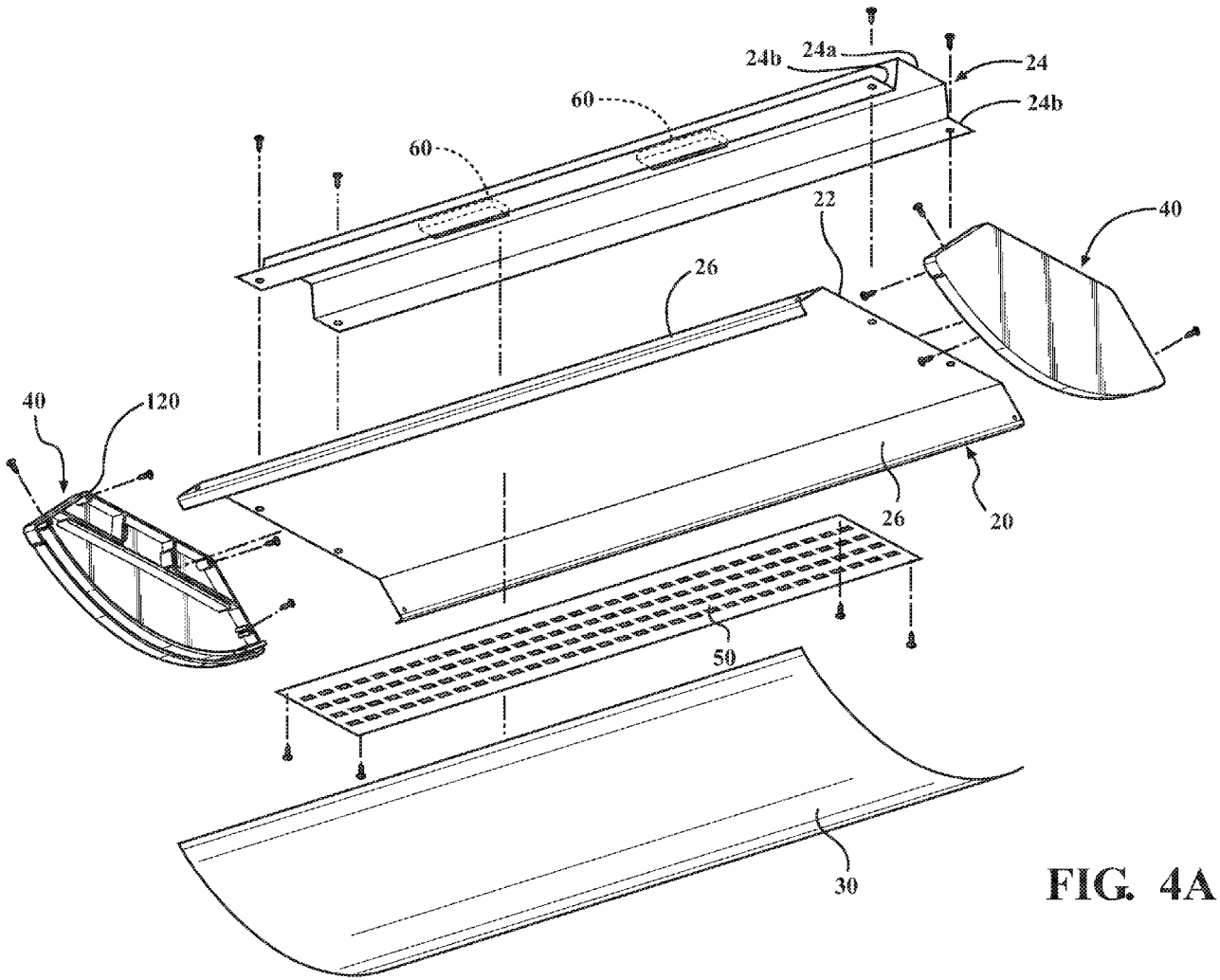
FIG. 4A is similar to FIG. 4, but shows the remainder of the main components of the luminaire in exploded assembly view.
Figure 5:
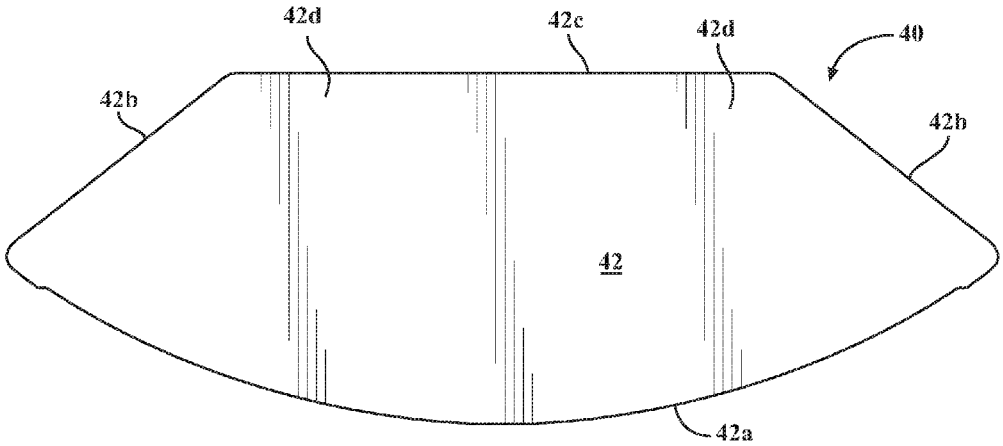
FIG. 5 is an outer face or end elevation view of the luminaire and end cap of FIG. 3.
Figure 6:
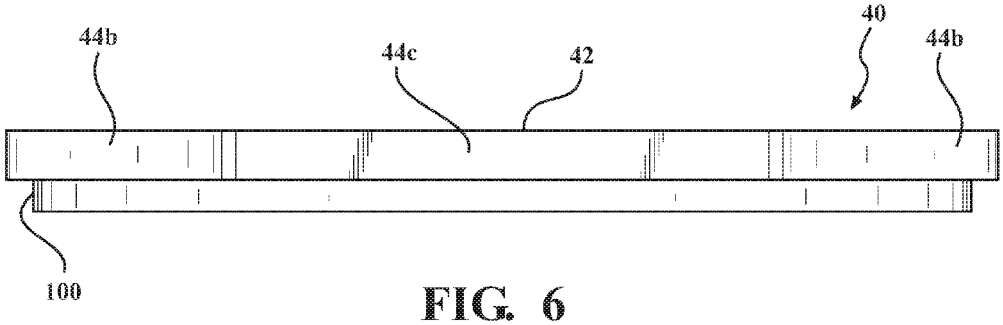
FIG. 6 is a top plan view of the luminaire and end cap of FIG. 3.
Figure 7:
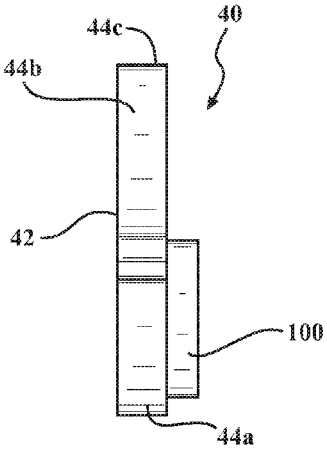
FIG. 7 is a side elevation view of the luminaire and end cap of FIG. 3, the opposite side elevation view being substantially identical.
Figure 8:
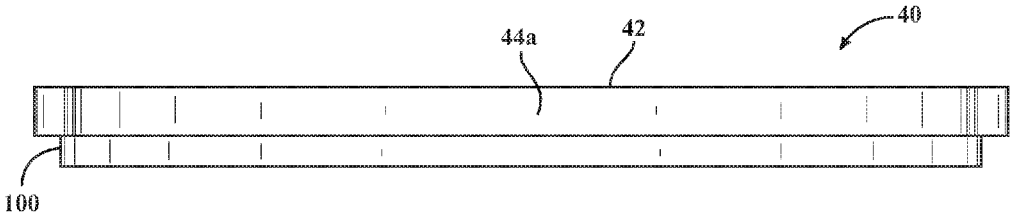
FIG. 8 is bottom plan view of the luminaire and end cap of FIG. 3.

Referring first to FIGS. 1 and 2, an exemplary luminaire 10 in accordance with the invention is shown in schematic form. Luminaire 10 includes a metal upper housing 20, a plastic lower lens 30, and a plastic end cap 40 on each end. Luminaire 10 is an elongated commercial light housing of the type commonly hung horizontally for work area lighting in business and industrial locations, for example from known types of hanging supports such as wires or strap (not shown), although it is not limited to such locations or mounting arrangements.

The metal upper housing 20 is preferably made of a lightweight heat-dissipating metal such as aluminum, while the plastic lens 30 and lens cap 40 may be made from various known translucent polymers, such as polycarbonate which is currently a preferred material. Housing 20 is used as a chassis for mounting a known type of elongated LED light-emitting tube or board 50, along with known types of drivers and wiring for controlling the LED board 50.

Translucent plastic end caps 40 improve light output for both down light and up light, without adding additional LEDs or other light sources or reflectors.

Additionally, as shown in FIGS. 1 and 2, plastic end caps 40 incorporate bosses 41 that create unique hard point mounting locations that allow for a mounting method passing typical known load testing requirements.

End caps 40 allow light from light source 50 to be emitted from both ends of the luminaire in a vertical plane, and all other angles as well. In particular the end caps 40 provide significant uplight in the vertical plane above, below, and to the sides of the cap.

Referring next to FIGS. 3 through 9, a specific embodiment of luminaire 10 and end cap 40 is illustrated.

Luminaire 10 includes a metal upper housing 20 having a flat upper main wall 22 and a driver-mounting middle channel 24, both made from lightweight aluminum. Together the outer ends of upper main wall 22 and driver channel 24 define a metal upper housing perimeter that is irregular, with rectangular raised interior channel portion 24*a* and outer flat side portions 22*a* to either side of raised channel portion 24*a*, and. In the illustrated example, driver channel 24 is formed separately from upper main wall 22, as a lightweight aluminum stamping or extrusion having a generally squared U-shape main body 24*a* with flat side mounting flanges 24*b*, and is subsequently assembled to upper main wall 22 using screws or other known fastening techniques.

The bottom of metal housing 20 is closed by an elongated translucent plastic lens 30, in the illustrated example having a convex curvature about its long axis. Lens 30 is secured at its outer edges to the outer edges 26 of metal housing 20, which are angled downwardly from the flat upper portion 22 of the housing at 26*a* and 26*b*, using screws or other known fastening means.

One or more LED boards 50 of known type are mounted directly to the inside surface of metal housing 20, for example with screws or other known fastening means. The direct contact between the flat back of the LED boards 50 and the flat metal of the housing provides good heat dissipation for the heat generated by the LEDs on the board.

One or more LED driver units 60 of known type containing the drivers and other electronics needed to control, regulate, and power the LED boards 50 are mounted in driver channel 24, specifically on the upper inside surface of main channel body 24*a*. Mounting may be with screws, adhesive, or any other suitable known fastening technique. The height of channel 24 and the size of driver units 60 are selected to provide an air channel 25 between the driver units and the upper main wall 22 of housing 20 beneath them. The air channel 25 is preferably continuous from one end of channel 24 to the other, i.e. along the full length of housing 20, and promotes convective heat dissipation. Wiring 62 extends from driver units 50 through suitable holes 64 in housing main wall 22 to supply the LED boards 50 with power and/or control signals in known manner to regulate their on/off status, light output, and other operating parameters.

Each end of luminaire 10 is closed by an end cap 40. End caps 40 in the illustrated example are made from a translucent plastic such as polycarbonate that provides an even, diffuse transmission of light from the LED boards 50 in the luminaire. Each end cap 40 has a generally vertical, preferably flat front face 42 with a perimeter whose lower portion 42*a* matches or is contiguous with the perimeter or end shape of lens 30, and whose upper portion, in the illustrated example angled outer sides 42*b* and straight upper edge 42*c* are at least partly non-contiguous with the perimeter or end shape of metal upper housing 20. In the illustrated example, cap front face 42 includes upper outer ear sections 42*d* located to either side of driver channel 24 that extend above the upper surface of metal housing 20 with nothing but air behind them.

End cap 40 further includes a horizontal, inwardly-extending perimeter lip or wall 44 following the perimeter of front face 42 and thus having a similar correspondence to the contour or perimeter of lens 30 along its lower portion, and a similar non-correspondence to the contour or perimeter of metal upper housing 20 along its upper portion. A lower portion 44*a* of perimeter wall 44 follows the curvature of the end of lens 30. First upper portions 44*b* of perimeter wall 44 follow the outer side contour or perimeter of outer side portions of metal upper housing 22, while second upper portions 44*c* of perimeter wall 44 diverge from the contour or perimeter of the inner part of housing 22, extending vertically above the metal housing in a vertical plane aligned with the plane of the end opening defined by the ends of housing 22 and lens 30.

Figure 9:
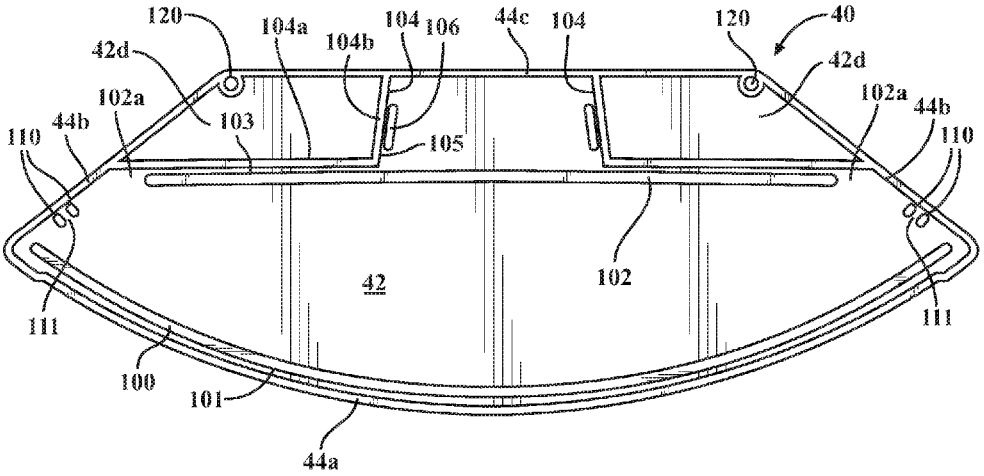
FIG. 9 is an inner face view of the end cap of FIG. 3.

Referring to FIGS. 9 and 10, the inner surface of end cap 40 includes a plurality of internal locating features within perimeter wall 44, formed by molding of the same translucent plastic as the remainder of the end cap, that help align and secure the cap to the end of luminaire 10 and that also provide internal light transmission received from the luminaire below the upper metal housing 20 through inner portions of the end cap to outer portions of the end cap, including to the end cap perimeter wall 44.

A lower curved locating flange 100 is spaced from and generally follows the contour of lower perimeter wall portion 44*a*, defining a channel 101 therebetween curved and sized to receive the end of lens 30 and, at its outer ends, outer angled side portions 26 of the metal housing that overlap the outer sides of the lens. A horizontal flat inner shelf 102 is formed to extend across an intermediate part of the inner side of cap face 42, stopping short of perimeter wall portions 44*b* at either end to leave a visible gap 102*a*. L-shaped flanges 104 are formed above shelf 102, generally corresponding to the upper contour of metal housing 20 along upper main wall 22 and driver channel 24. The horizontal portions 104*a* of flanges 104 cooperate with outer portions of shelf 102 to define channels 103 that receive outer edge portions of flat metal upper wall 22 of the housing 20. The vertical portions 104*b* of flanges 104 cooperate with vertical tabs 106 to form channels 105 that receive the edges of the vertical sides of driver channel 24.

The inner face of end cap 40 may also include screw locating ribs 110 defining locating slots 111 for the tips of screws threaded through the perimeter wall of cap 40 or through the metal housing to secure the cap to the housing.

In the illustrated example, best shown in FIG. 9, suspension mounting points 120 are formed in the upper outer ear portions 42*d* of end cap 40 to be positioned above and outside the metal upper housing 20 when the end cap 40 is assembled to the luminaire. Illustrated mounting points 120 are shown as sockets or bosses molded into the end cap adjacent the corners of the perimeter wall 44 to receive screws, bolts, hooks, or similar connecting members to which suspension wires or hangers can be attached from a ceiling.

Referring now to FIG. 11, the upper corner portions or "ears" 42*d* of end cap 40 located exteriorly of L-shaped channel receiving flanges 104 extend above the metal housing 20, in particular above the adjacent flat upper wall portions 22*a*. This is best shown in FIG. 11, which also shows an optional gap 130 that may be maintained between the outer edge of metal housing 20 along at least some of its boundary with the face 42 of end cap 40 when the cap is assembled on the luminaire housing. This gap allows additional light from below the metal housing to be leaked or emitted directly to some of the internal flanges or locating features such as 104 and through those features to portions of end cap perimeter wall 44 above upper metal housing 20, in order to increase the light emitted from the perimeter wall 44 and ear portions 42*d*.

It will finally be understood that the disclosed embodiments represent presently preferred examples of how to make and use the invention, but are intended to enable rather than limit the invention. Variations and modifications of the illustrated examples in the foregoing written specification and drawings may be possible without departing from the scope of the invention. For example, the inventive end cap is not intended to be limited to the specific shape of luminaire or end cap shown in the illustrated example. It should further be understood that to the extent the term "invention" is used in the written specification, it is not to be construed as a limiting term as to number of claimed or disclosed inventions or discoveries or the scope of any such invention or discovery, but as a term which has long been conveniently and widely used to describe new and useful improvements in science and the useful arts. The scope of the invention should accordingly be construed by what the above disclosure teaches and suggests to those skilled in the art, and by any claims that the above disclosure supports in this application or in any other application claiming priority to this application.

What is claimed is:

1. In combination with a luminaire comprising an elongated horizontal opaque metal upper housing, an elongated horizontal downward facing plastic lens, the metal upper housing and the plastic lens forming a luminaire housing and each having an end perimeter defining together a luminaire end perimeter defining a luminaire cross-sectional area, and a horizontal elongated light emitter contained between the metal upper housing and the plastic lens, a translucent end cap comprising:

a translucent vertical end face having an outer perimeter defining an area greater than the luminaire cross sectional area, an upper portion of the translucent vertical end face extending vertically above the metal upper housing, and an upper portion of the outer perimeter being non-contiguous with the luminaire end perimeter and extending vertically above the metal upper housing;

a translucent horizontal perimeter wall contiguous with the outer perimeter of the vertical end face and extending horizontally inwardly from the translucent vertical end face toward the luminaire housing, an upper portion of the translucent horizontal perimeter wall spaced above the metal upper housing; wherein, the upper portion of the translucent horizontal perimeter wall emits light in a vertical plane in a substantially continuous band above the metal upper housing.

2. The combination of claim 1, wherein a remainder of the translucent horizontal perimeter wall emits light in a vertical plane in a substantially continuous band below the metal upper housing.

3. The combination of claim 1, wherein a suspension mounting point is formed in one of the translucent upper portions of the end cap above the metal upper housing.

4. The combination of claim 1, wherein a portion of the metal upper housing perimeter edge is spaced from the translucent vertical end face of the end cap such that a light emitting gap is formed relative to the upper portion of the translucent vertical end face of the end cap.

5. The combination of claim 4, wherein an inner face of the translucent vertical end face of the end cap includes translucent locating features for the metal upper housing perimeter edge adjacent the light emitting gap to transmit light from below the metal upper housing to portions of the translucent horizontal perimeter wall above the metal upper housing.

* * * * *